US009841246B2

(12) United States Patent
Lin

(10) Patent No.: US 9,841,246 B2
(45) Date of Patent: Dec. 12, 2017

(54) DUAL MATERIAL VAPOR CHAMBER AND UPPER SHELL THEREOF

(71) Applicant: TAIWAN MICROLOOPS CORP., New Taipei (TW)

(72) Inventor: Chun-Hung Lin, New Taipei (TW)

(73) Assignee: TAIWAN MICROLOOPS CORP., New Taipei (TW)

( * ) Notice: Subject to any disclaimer, the term of this patent is extended or adjusted under 35 U.S.C. 154(b) by 17 days.

(21) Appl. No.: 15/075,525

(22) Filed: Mar. 21, 2016

(65) Prior Publication Data

US 2017/0268835 A1 Sep. 21, 2017

(51) Int. Cl.

| | |
|---|---|
| ***F28F 7/00*** | (2006.01) |
| ***F28F 21/08*** | (2006.01) |
| ***F28F 3/04*** | (2006.01) |
| ***F28D 15/04*** | (2006.01) |
| ***F28D 15/02*** | (2006.01) |

(52) U.S. Cl.

CPC ..... *F28F 21/081* (2013.01); *F28D 15/02* (2013.01); *F28D 15/025* (2013.01); *F28D 15/046* (2013.01); *F28F 3/048* (2013.01); *F28F 21/084* (2013.01); *F28F 21/085* (2013.01); *F28F 21/089* (2013.01); *F28D 2015/0216* (2013.01)

(58) Field of Classification Search

CPC ..... F28F 21/081; F28F 3/048; F28F 21/084; F28F 21/085; F28F 21/089; F28D 15/02; F28D 15/025; F28D 15/046

See application file for complete search history.

(56) References Cited

U.S. PATENT DOCUMENTS

| | | | | |
|---|---|---|---|---|
| 6,871,701 | B2 * | 3/2005 | Ueki | F28D 15/0233 165/104.26 |
| 7,942,196 | B2 * | 5/2011 | Lai | F28D 15/0233 165/104.21 |
| 9,291,398 | B2 * | 3/2016 | Yang | F28D 15/0266 |
| 2008/0174963 | A1 * | 7/2008 | Chang | F28D 15/0233 361/700 |

(Continued)

OTHER PUBLICATIONS

Micro /Miniature Heat Pipe Technology for Electronic Cooling; Amir Faghri, Ph.D.; Jul. 1997; Department of Mechanical and Materials Engineering Wright State University.*

(Continued)

*Primary Examiner* — Len Tran
*Assistant Examiner* — Gordon Jones
(74) *Attorney, Agent, or Firm* — Chun-Ming Shih; HDLS IPR Services

(57) ABSTRACT

In a dual material vapor chamber and an upper shell thereof, the dual material vapor chamber includes an upper shell, a copper lower shell, and a working fluid. The upper shell includes an aluminum substrate and plural aluminum fins. The aluminum substrate has an outer surface and an inner wall. The aluminum fins individually extend from the outer surface and are formed integrally. A copper deposition layer is coated on the inner wall. The copper lower shell is sealed to the upper shell correspondingly. A chamber is formed between the upper shell and the copper lower shell. The working fluid is filled in the chamber. Therefore, the weight and material cost of the whole vapor chamber can be reduced, and the packing combination between the upper shell and the copper lower shell can be simplified.

2 Claims, 7 Drawing Sheets

(56) References Cited

U.S. PATENT DOCUMENTS

| | | | | |
|---|---|---|---|---|
| 2009/0056917 | A1* | 3/2009 | Majumdar | F28D 15/0233 165/104.26 |
| 2010/0139893 | A1* | 6/2010 | Ding | F28D 15/046 165/104.26 |
| 2011/0171426 | A1* | 7/2011 | Chen | B05D 1/62 428/141 |
| 2013/0126132 | A1* | 5/2013 | Chen | F28D 15/04 165/104.26 |

OTHER PUBLICATIONS

Electrodeposition of Nickel—Copper Alloys and Nickel—Copper-Alumina Nanocomposites Into Deep Recesses for MEMS; Amrit Panda; B.S., Anna University, 1997 , May 2003 ; Louisiana State University and Agricultural and Mechanical College.*

* cited by examiner

DUAL MATERIAL VAPOR CHAMBER AND UPPER SHELL THEREOF

BACKGROUND OF THE INVENTION

Field of the Invention

The present invention relates to a vapor chamber and in particular to a dual material vapor chamber and an upper shell thereof, which are used for an electronic heat source.

Description of Prior Art

While the operating speeds of the electronic components increase continuously, the heat generated increase accordingly. To effectively solve the problem of the large amount of heat generated, the vapor chamber with excellent heat transfer performance has been widely used in the industry. However, the traditional vapor chamber still needs improvements in heat transfer efficiency, manufacturing cost, and manufacturing simplification.

The traditional vapor chamber mainly comprises an upper shell and a lower shell. The upper and lower shells are both made of copper. Firstly, the internal spaces of the upper and lower shells are individually provided with wick structures. Then, the upper and lower shells are welded together correspondingly. Next, a working fluid is filled into the internal spaces of the upper and lower shells. Finally, the manufacturing processes of degas and sealing are fulfilled.

However, the traditional vapor chamber has the effect of heat transfer, but it suffers the following problems in practical use. The upper and lower shells are both made of copper, which cause a heavy weight of the whole vapor chamber. Also, the material cost of copper is many times as high as that of aluminum; consequently, the manufacturing cost of the traditional vapor chamber has not been reduced effectively.

SUMMARY OF THE INVENTION

An objective of the present invention is to provide a dual material vapor chamber and an upper shell thereof, which can reduce the total weight and material cost of the whole vapor chamber and simplify the packing combination between the upper shell and the copper lower shell.

In order to achieve the above objective, the present invention provides a dual material vapor chamber comprising an upper shell, a copper lower shell, and a working fluid. The upper shell comprises an aluminum substrate and a plurality of aluminum fins. The aluminum substrate has an outer surface and an inner wall formed on the opposite side of the outer surface. The aluminum fins individually extend from the outer surface and are formed integrally. A copper deposition layer is coated on the inner wall. The copper lower shell is sealed to the upper shell correspondingly. A chamber is formed between the upper shell and the copper lower shell. The working fluid is filled in the chamber.

In order to achieve the above objective, the present invention also provides an upper shell of a dual material vapor chamber. The upper shell comprises an aluminum substrate and a plurality of aluminum fins. The aluminum substrate has an outer surface and an inner wall formed on the opposite side of the outer surface. The aluminum fins individually extend from the outer surface and formed integrally. A copper deposition layer is coated on the inner wall.

The present invention also has the following effects. By means of excellent hydrophobic property of the copper deposition layer, a good circulation of the internal working fluid can be achieved. By means of the disposition of the nickel deposition layer, the adhering force of the copper deposition layer to the inner wall can be enhanced. The fluid stagnation structure can destroy the cohesion of water molecules; thus, the water molecules which are attached to the fluid stagnation structure after condensation will not gather and flow such that all water molecules can completely drop onto the heated section of the lower shell.

DETAILED DESCRIPTION OF THE INVENTION

Figure 1:
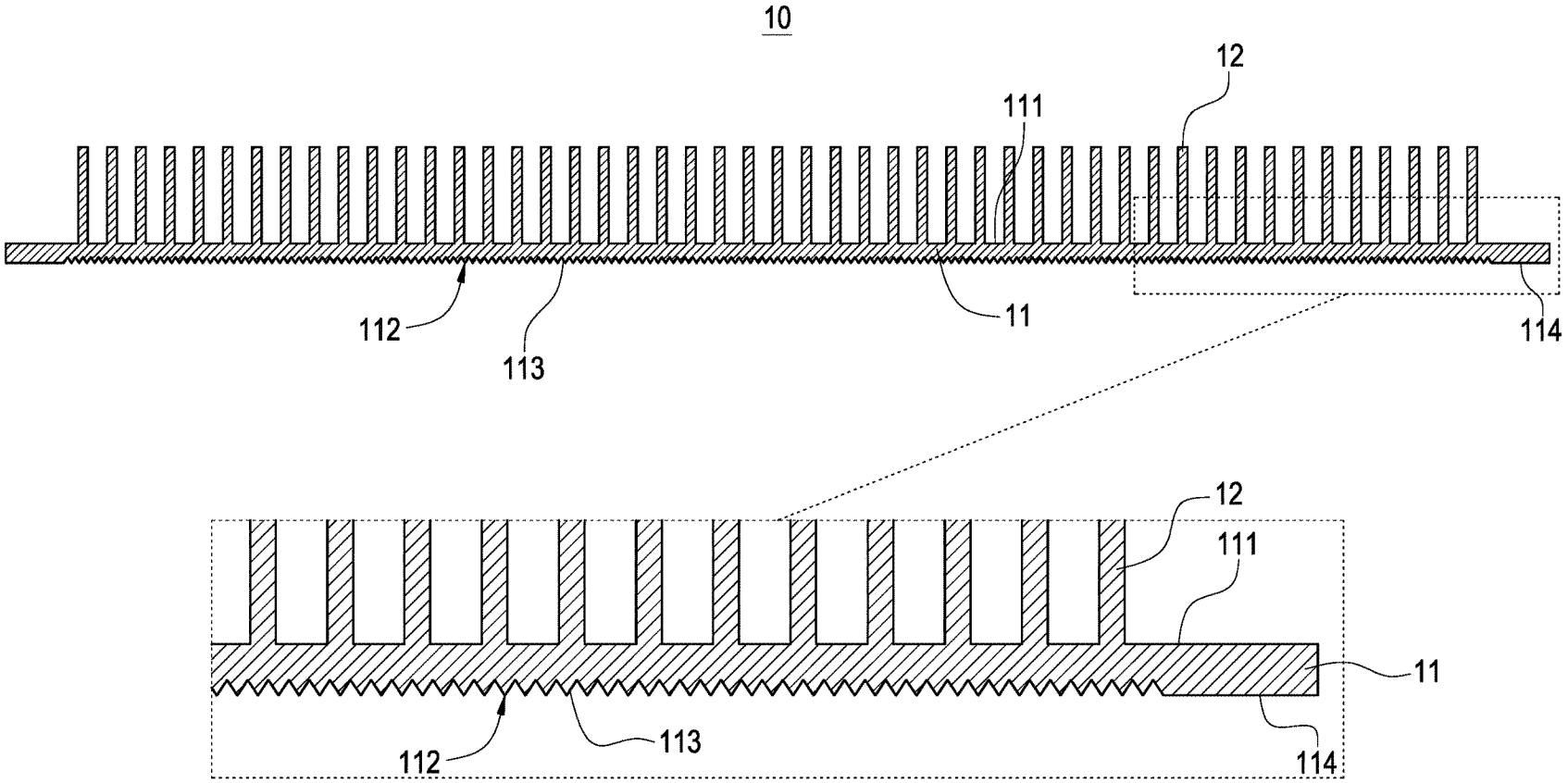
FIG. 1 is a cross-sectional view of an upper shell of the present invention.
Figure 2:
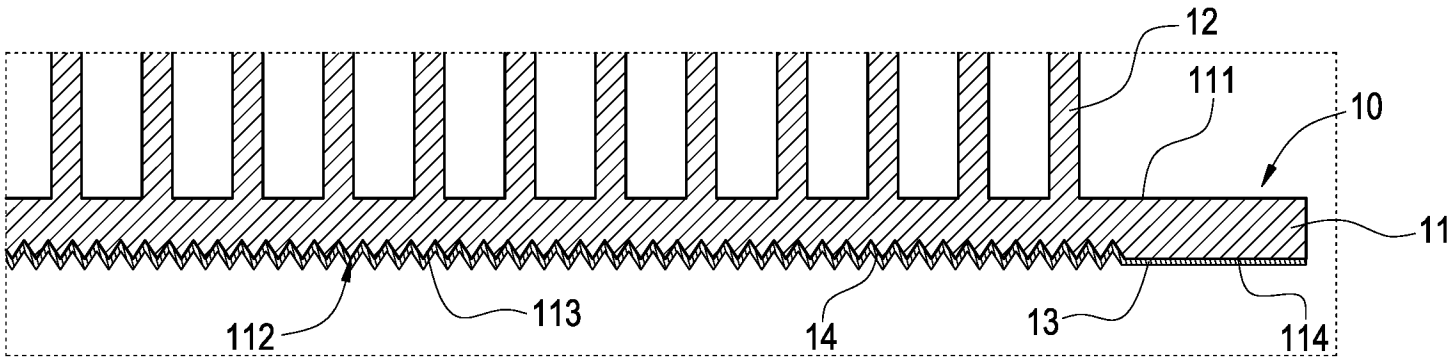
FIG. 2 is a cross-sectional view of the upper shell of FIG. 1 coated with a copper deposition layer.
Figure 3:
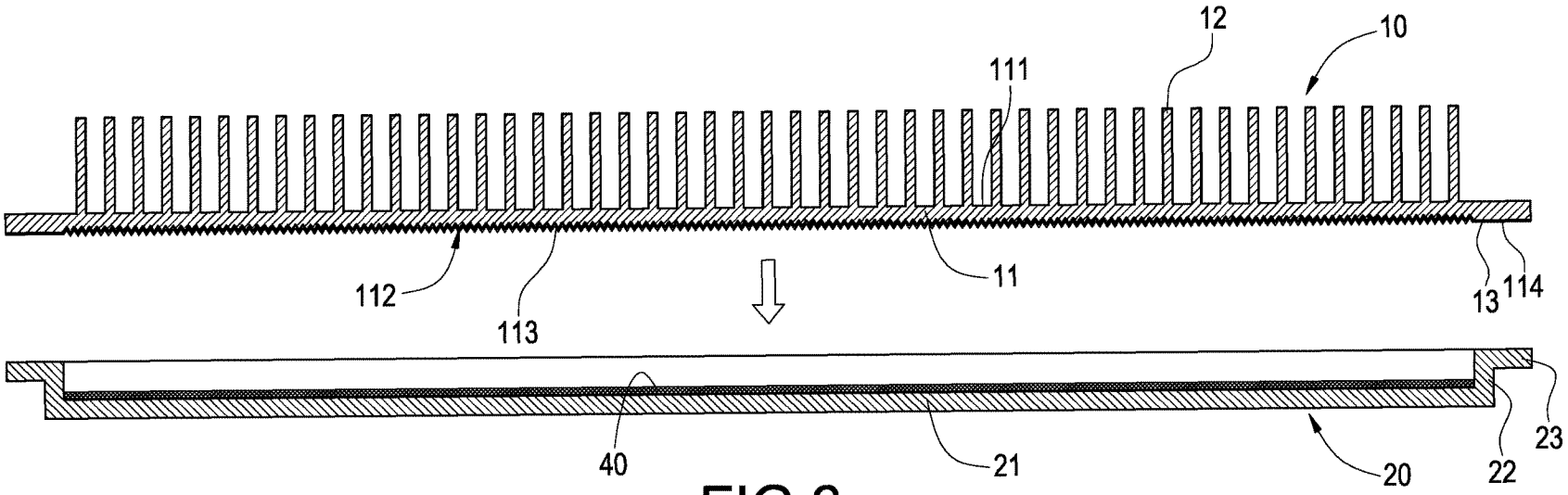
FIG. 3 is an exploded cross-sectional view of the dual material vapor chamber of the present invention.
Figure 4:
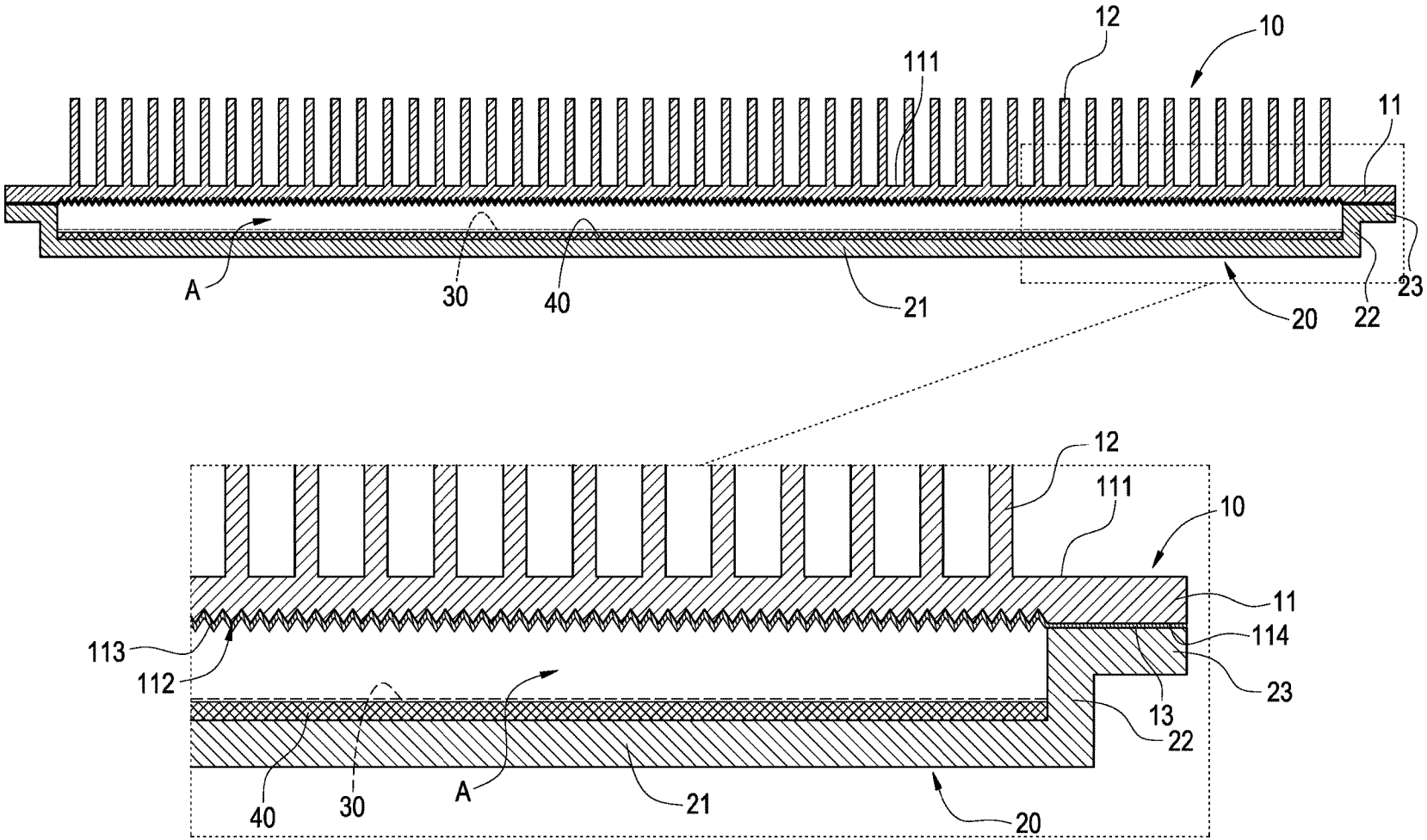
FIG. 4 is a cross-sectional assembled view of the dual material vapor chamber of the present invention.
Figure 5:
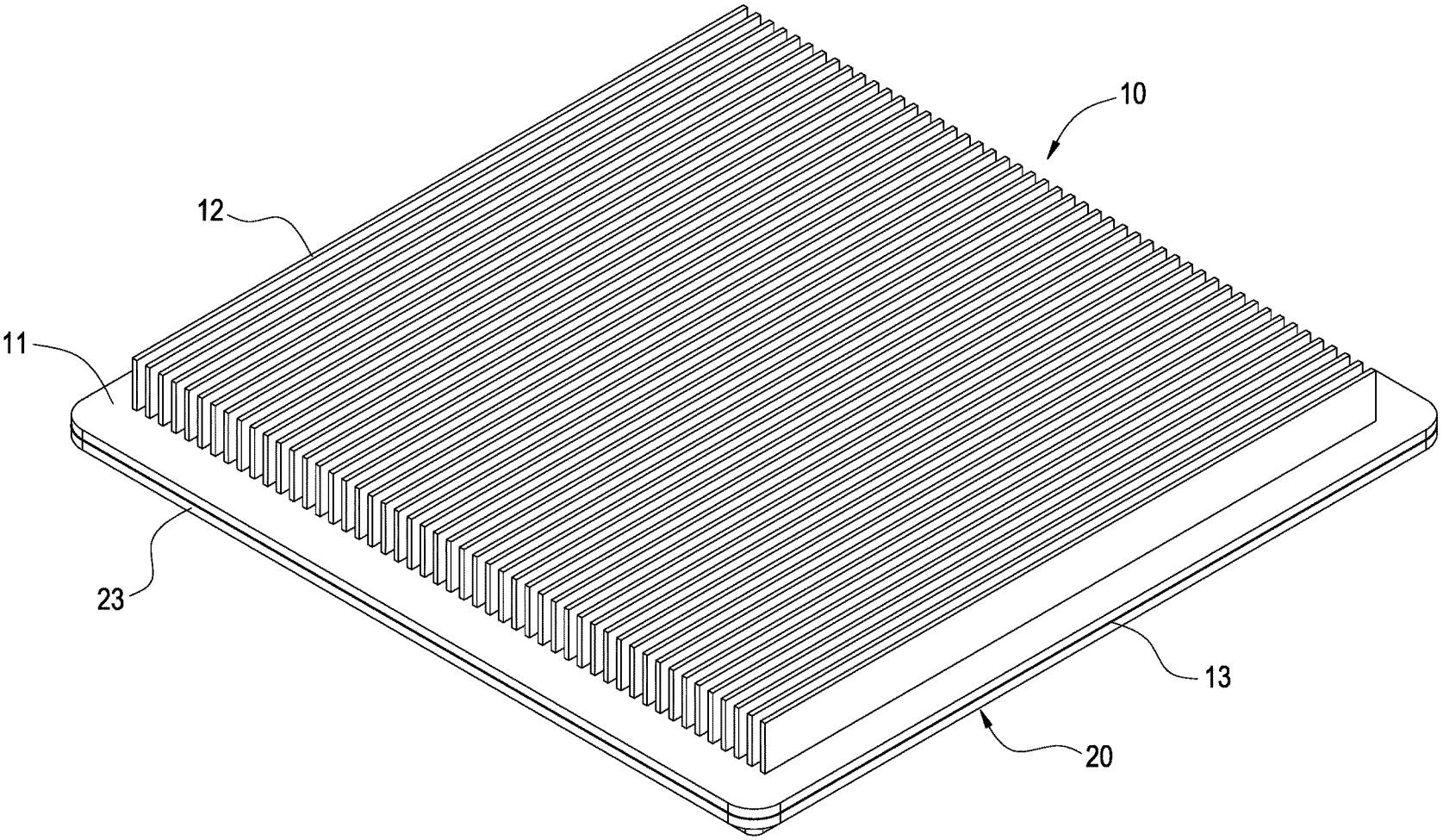
FIG. 5 is a perspective assembled view of the dual material vapor chamber of the present invention.

The detailed description and technical details of the present invention will be explained below with reference to accompanying figures. However, the accompanying figures are only for reference and explanation, but not to limit the scope of the present invention.

Please refer to FIGS. 1-5. The present invention provides a dual material vapor chamber and an upper shell thereof. The dual material vapor chamber comprises an upper shell 10, a copper lower shell 20, and a working fluid 30.

The upper shell 10 which is made of aluminum or the alloy thereof mainly comprises an aluminum substrate 11 and a plurality of aluminum fins 12. The aluminum substrate 11 which roughly has a cuboid shape has an outer surface 111 and an inner wall 112 formed on the opposite side of the outer surface 111. A copper deposition layer 13 may be coated on the inner wall 112 by electroplating. The aluminum fins 12 individually extend from the outer surface 111 and are formed integrally in which the aluminum fins 12 can be formed spacedly by extrusion or chipping.

Further, the inner wall 112 can thoroughly form a fluid stagnation structure 113 by a machining process such as sandblasting or embossing. The fluid stagnation structure 113 is a rough surface containing a plurality of particles having a surface roughness (Ra) ranging from 0.01 mm to 10 mm, preferably ranging from 0.05 mm to 3 mm. If the surface roughness (Ra) is below 0.01 mm, the fluid stagnation structure 113 cannot effectively prevent the internal working fluid 30 from flowing and gathering after condensation. If the surface roughness (Ra) is above 10 mm, the whole vapor chamber is too high to meet the use requirement of electronic components. Also, an upper connecting section 114 is formed around the perimeter of the fluid stagnation structure 113. The copper deposition layer 13 is coated on the upper connecting section 114; thus, the subsequent welding process can be performed easier.

The copper lower shell 20 which is made of copper or the alloy thereof comprises a base plate 21, a lower surrounding plate 22 extending and bent upward from the perimeter of the base plate 2, and a lower connecting section 23 extending and bent transversely from the perimeter of the lower surrounding plate 22. The copper lower shell 20 is sealed to the upper shell 10 correspondingly; a chamber A is formed between the upper shell 10 and the copper lower shell 20. During the assembly, the surfaces of the upper connecting section 114 and the lower connecting section 23 are applied with solder and then stacked to each other and heated such that the upper shell 10 and the copper lower shell 20 are sealed together.

The working fluid 30 which can be pure water is filled into the chamber A through an infusion-degassing tube (not shown) to perform the processes such as degassing and sealing to complete the fabrication of the dual material vapor chamber. In the present invention, a copper deposition layer 13 is coated on the inner wall 112 of the aluminum substrate 11. Because the hydrophobicity of the copper deposition layer 13 is superior to that of the aluminum inner wall 112, water as a working fluid 30 can have a good effect of internal circulation.

Moreover, the vapor chamber of the present invention further comprises a wick structure 40, which can be metal weaving net, porous metal sintered powder, or fiber bundles. The wick structure 40 is disposed above the base plate 21 of the copper lower shell 20.

Figure 6:
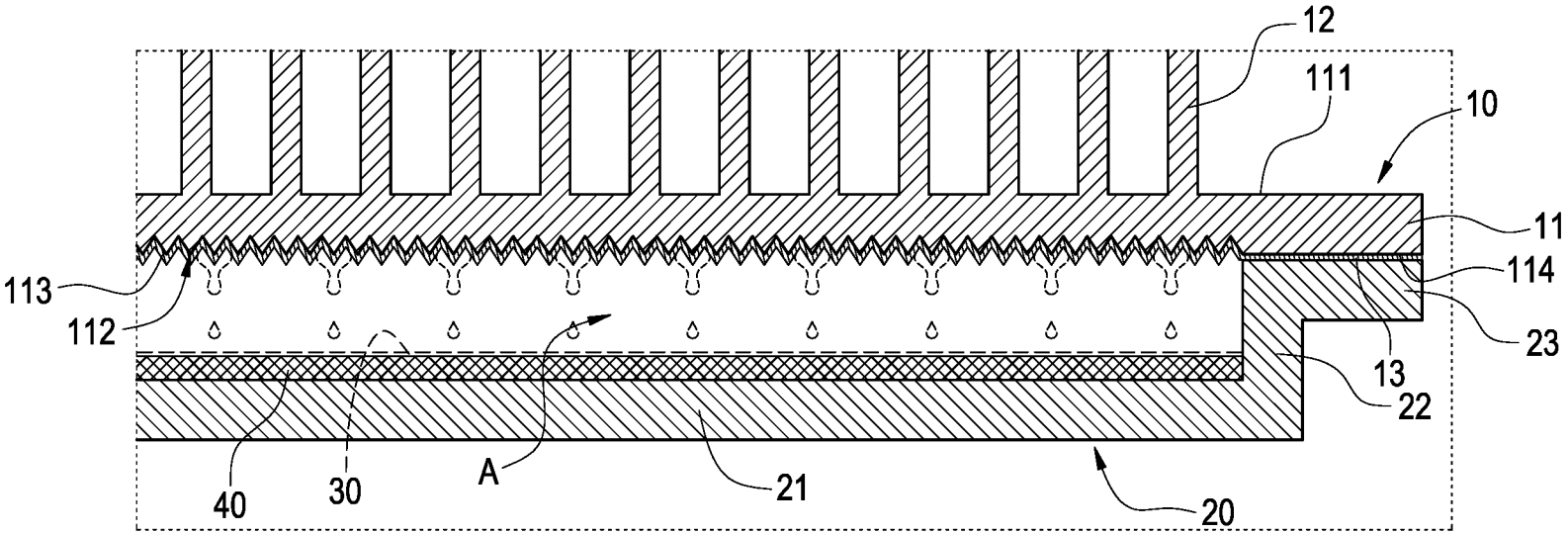
FIG. 6 is a local enlarged view of the dual material vapor chamber of the present invention during operation.

Referring to FIG. 6, the base plate 21 of the copper lower shell 20 is used as a heated section during operation and is placed to contact the electronic heat source (not shown). Thus, the heat generated during operation will be delivered to the base plate 21 and the working fluid 30. Then, the liquid working fluid 30 is heated and evaporated into the vapor working fluid 30. Due to the heat dissipation effect of the aluminum substrate 11 through the aluminum fins 12, when the vapor working fluid 30 flows toward the inner wall 112 of the aluminum substrate 11, it will be attached to the copper deposition layer 13 of the fluid stagnation structure 113 such that after the vapor working fluid 30 contacts the copper deposition layer 13 of the fluid stagnation structure 113, it is condensed into many distributed water molecules. Because the fluid stagnation structure 113 can destroy the cohesion of water molecules, the water molecules attached to the fluid stagnation structure 113 after condensation will not gather and flow. In this way, all water molecules can completely drop onto the heated section (i.e., the base plate 21) of the lower shell.

Figure 7:
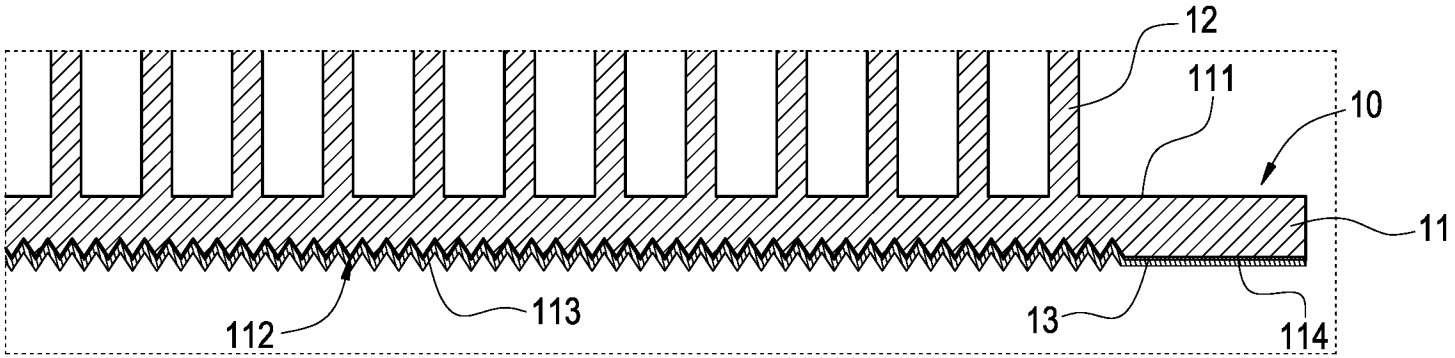
FIG. 7 is a cross-sectional view of the upper shell according to another embodiment of the present invention.

Referring to FIG. 7, in addition to the previous embodiment, the upper shell 10 of the present invention further comprises a nickel deposition layer 14 disposed between the inner wall 112 and the copper deposition layer 13. Thus, the adhering force of the copper deposition layer 13 to the inner wall 112 can be enhanced.

In summary, the dual material vapor chamber and the upper shell thereof of the present invention indeed achieves the expected objectives and overcomes the problems of the prior art. Also they are indeed novel, useful, and non-obvious to be patentable. Please examine the application carefully and grant it as a formal patent for protecting the rights of the inventor.

What is claimed is:

1. A dual material vapor chamber, comprising:

an upper shell comprising an aluminum substrate and a plurality of aluminum fins, wherein the aluminum substrate has an outer surface and an inner wall formed on an opposite side of the outer surface, wherein the aluminum fins individually extend from the outer surface and are formed integrally;

a copper lower shell sealed to the upper shell correspondingly, wherein a chamber is formed between the upper shell and the copper lower shell; and a working fluid filled in the chamber, wherein a fluid stagnation structure is disposed on the inner wall, and a copper deposition layer is coated on the fluid stagnation structure, and the upper shell further comprises a nickel deposition layer disposed between the fluid stagnation structure and the copper deposition layer, so that adhering force of the copper deposition layer to the inner wall can be enhanced by the nickel deposition layer;

wherein the aluminum substrate further extends to form an upper connecting section from outermost fins of the plurality of aluminum fins, and the upper connecting section has the copper deposition layer coated thereon, and wherein the copper lower shell comprises a base plate, a lower surrounding plate extending and bent from the perimeter of the base plate, and a lower connecting section extending and bent from a perimeter of the lower surrounding plate, wherein the lower connecting section and the upper connecting section connect to each other to clamp the copper deposition layer.

2. The dual material vapor chamber according to claim 1, wherein the fluid stagnation structure is a rough surface containing a plurality of particles.

* * * * *